US008988413B2

(12) United States Patent
Huang et al.

(10) Patent No.: US 8,988,413 B2
(45) Date of Patent: Mar. 24, 2015

(54) DISPLAY APPARATUS AND DISPLAY METHOD THEREOF

(75) Inventors: Wei-Te Huang, Hsinchu (TW); Chi-Ming Wu, Hsinchu (TW); Cheng-Te Lai, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 204 days.

(21) Appl. No.: 13/586,852

(22) Filed: Aug. 15, 2012

(65) Prior Publication Data

US 2013/0278583 A1 Oct. 24, 2013

(30) Foreign Application Priority Data

Apr. 20, 2012 (TW) ..... 101114197 A

(51) Int. Cl.
*G09G 3/00* (2006.01)
*G09G 3/36* (2006.01)

(52) U.S. Cl.
CPC ..... *G09G 3/3696* (2013.01); *G09G 2320/0219* (2013.01)
USPC ..... 345/212; 345/204

(58) Field of Classification Search
USPC ..... 315/169.3, 297, 318; 345/100, 206, 345/207, 211, 212, 214, 549, 55, 58, 589, 345/629, 690, 76, 87, 89; 348/578, 645
See application file for complete search history.

(56) References Cited

U.S. PATENT DOCUMENTS 6,831,662 B1 12/2004 Lum et al.
6,961,029 B1 11/2005 Canova, Jr. et al.
7,724,270 B1 5/2010 Lum et al.
2004/0239667 A1* 12/2004 Takahashi ..... 345/212
2006/0061524 A1* 3/2006 Suh et al. ..... 345/76
2006/0109391 A1 5/2006 Huitema et al.
2007/0242162 A1* 10/2007 Gutta et al. ..... 348/645
2008/0266243 A1 10/2008 Johnson et al.
2010/0220122 A1 9/2010 Zehner et al.

(Continued)

FOREIGN PATENT DOCUMENTS

CN 1527271 9/2004
CN 1744181 3/2006
CN 1977542 6/2007

OTHER PUBLICATIONS

"Office Action of Taiwan Counterpart Application", issued on Mar. 12, 2014, p. 1-p. 5.

(Continued)

*Primary Examiner* — Ariel Balaoing
*Assistant Examiner* — Sepehr Azari
(74) *Attorney, Agent, or Firm* — Jianq Chyun IP Office

(57) ABSTRACT

A display apparatus and a display method thereof are provided. The display apparatus includes a display panel, a timing controller, a data driving unit and an extending driving unit. The display includes a plurality of first pixels disposed in a frame display region and a plurality of second pixels disposed in an extending display region, where the extending display region surrounds the frame display region. The timing controller outputs a plurality of display data corresponding to a display frame. The data driving unit outputs a plurality of first signals to the first pixels according to the display data. The extending driving unit obtains a display reference data corresponding to the display frame through the data driving unit, and provides a second driving signal to the second pixels according to the display reference data so as to determine the display effect of the second pixels.

8 Claims, 9 Drawing Sheets

(56) References Cited

U.S. PATENT DOCUMENTS

| | | | |
|---|---|---|---|
| 2010/0302287 | A1 | 12/2010 | Katayama et al. |
| 2011/0102401 | A1 | 5/2011 | Feng |
| 2011/0141003 | A1 | 6/2011 | Kim et al. |
| 2011/0157256 | A1 | 6/2011 | Sakamoto |
| 2011/0279442 | A1 | 11/2011 | Hage et al. |
| 2011/0285754 | A1 | 11/2011 | Harrington et al. |
| 2012/0062527 | A1 | 3/2012 | Cheong et al. |

OTHER PUBLICATIONS

"Office Action of China Counterpart Application," issued on Dec. 3, 2014, pp. 1-8, in which the listed references were cited.

* cited by examiner

DISPLAY APPARATUS AND DISPLAY METHOD THEREOF

CROSS-REFERENCE TO RELATED APPLICATION

This application claims the priority benefit of Taiwan application serial no. 101114197, filed on Apr. 20, 2012. The entirety of the above-mentioned patent application is hereby incorporated by reference herein and made a part of this specification.

BACKGROUND OF THE INVENTION

1. Field of the Invention

The invention relates to a display apparatus and display method thereof, and more particularly relates to a display apparatus has two display area and the display method thereof.

2. Description of Related Art

With the advance in science and technology, electronic devices become inseparable in daily life, and humanized electronic devices with excellent functions continually innovate as well. Display panels are generally disposed in various types of electronic devices and serve as media of the circuit and the user. In general, a display panel may be a liquid crystal display panel, an organic light emitting diode (OLED) display panel, an electrophoretic display (EPD) display panel, and an electrowetting (EWD) display panel.

Furthermore, a display panel would be divided into two display regions in some electronic devices, namely a major display region and a peripheral display region surrounding the major display region are respectively displaying screens and colors (or grey scales), wherein most of the peripheral display region displaying colors (or grey scales) shows the corresponding colors (or grey scales) relatively to the configurations set by users. However, the colors (or grey scales) configured by users may probably discoordinate with the screen shown by the major display region of the display panel such that affect the whole display effect. Moreover, since the colors (or grey scales) shown by display panel correspond with the configurations set by the users, the peripheral display region displaying the colors (or grey scales) would become invalid and is not capable of providing any assistance in the display effect.

In addition, due to the display requirements are simpler in peripheral display region, the structure of the pixels disposed thereof is different with the structure of pixels disposed in major display region, and thus the pixels structures in two display regions should both be taken into consideration when driving a display panel, such that the pixels of the two display regions could correctly show the expected colors (or grey scales).

SUMMARY OF THE INVENTION

The invention directed to a display apparatus and display method thereof, an extending display region of a display panel is changed corresponding to a frame displayed on a frame display region so as to improve the display effect of the frame.

An embodiment of the invention provides a display apparatus including a display panel, a timing controller, a data driving unit, and an extending driving unit. The display panel has a plurality of first pixels and a plurality of second pixels, wherein the first pixels are disposed in a frame display region of the display panel, while the second pixels are disposed in an extending display region of the display panel, and the extending display region surrounds the frame display region. The timing controller receives a frame data corresponding to a display frame and outputs a plurality of display data correspondingly. The data driving unit is coupled the first pixels and timing controller so as to receive the display data and provides a plurality of first driving signals to the first pixels according to the display data. The extending driving unit is coupled to the second pixels and the data driving unit, and receive a display reference data corresponding to the display frame through the data driving unit. The extending driving unit provides a second driving signal to the second pixels according to the display reference data so as to determine the display effect of the second pixels.

An embodiment of the invention provides a display method of a display apparatus, which includes the steps below. Receiving a frame data corresponding to a display frame and correspondingly outputs a plurality of display data. Providing a plurality of first driving signals to a plurality of first pixels according to the display data, wherein the first pixels are disposed in a frame display region of a display panel. Receiving a display reference data corresponding to the display frame. Providing a second driving signal to a plurality of second pixels according to the display reference data so as to determine the display effect of the second pixels, wherein the second pixels are disposed in an extending display region of the display panel, and the extending frame display region surrounds the frame display region.

Based on the above, the display apparatus and the display method thereof of the embodiments of the invention are generate the second driving signal according to the display reference data corresponding to the display frame, such that the display effect of the extending display region is changed corresponding to the display frame shown in frame display region so as to improve the display effect of the display frame.

The abovementioned features, aspects, and advantages of the invention will become more obvious and better understood with regard to the following description of the embodiments, appended claims, and accompanying drawings in the below.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DESCRIPTION OF EMBODIMENTS

Figure 1:
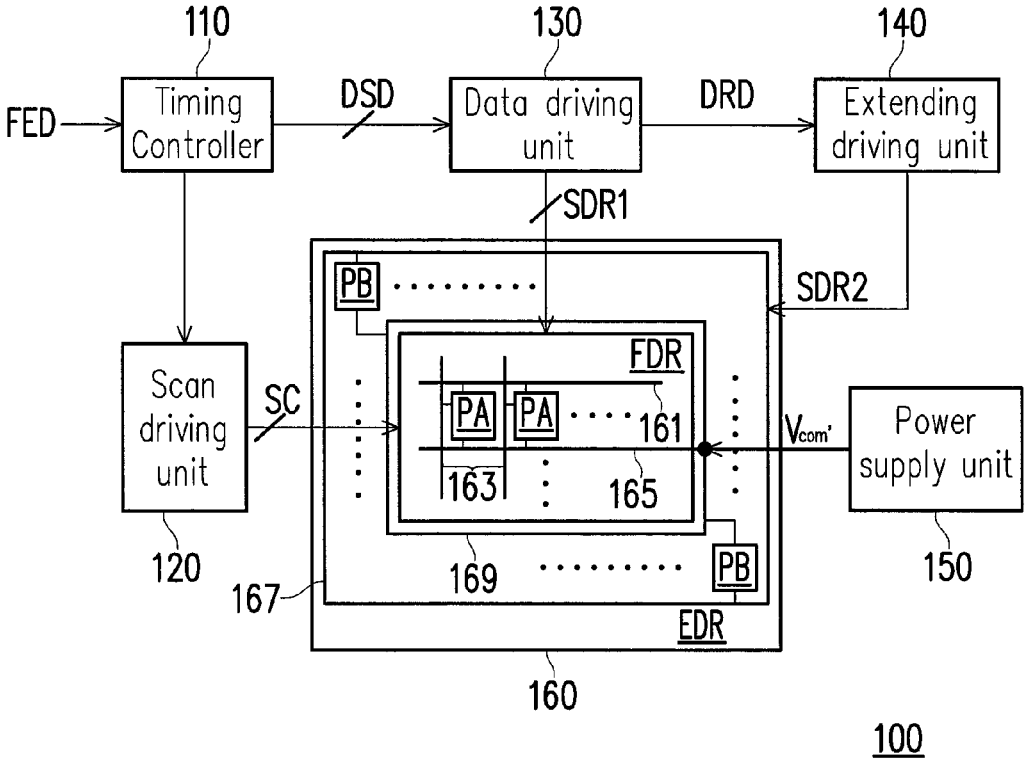
FIG. 1 is a system schematic diagram of a display apparatus according to an embodiment of the invention.

FIG. 1 is a system schematic diagram of a display apparatus according to an embodiment of the invention. Referring to FIG. 1, the display apparatus 100 of the present embodiment includes a timing controller 110, a scan driving unit 120, a data driving unit 130, an extending driving unit 140, a power supply unit 150, and a display panel 160. The display panel 160 has a plurality of first pixels PA and a plurality of second pixels PB, wherein the first pixels PA are disposed in the frame display region FDR of the display panel 160, the second pixels PB are disposed in the extending display region EDR of the display panel 160, and the extending display region EDR surrounds the frame display region FDR. The timing controller 110 receives a frame data FED corresponding to a display frame and correspondingly outputs a plurality of display data DSD.

The scan driving unit 120 is coupled to the timing controller 110, and is controlled by the timing controller 110 and outputs a plurality of scan signals SC in sequence so as to activate the first pixels PA. The data driving unit 130 is coupled to the first pixels PA and the timing controller 110 so as to receive the display data DSD from the timing controller 110 and to provide a plurality of first driving signals SDR1 to the first pixels PA according to the display data DSD. The extending driving unit 140 is coupled to the second pixels PB and the data driving unit 130, and receives a display reference data DRD corresponding to the display frame through the data driving unit 130. The extending driving unit 140 provides a second driving signal SDR2 to the second pixels PB so as to determine the display effect of the second pixels PB (e.g. colors and/or grey scales) according to the display reference data DRD. The power supply unit 150 is coupled to the display panel 160 so as to provide a common voltage Vcom' to the display panel 160, and the common voltage Vcom' is serves as a basis of the first pixels PA and the second pixels PB when displaying.

In an embodiment of the invention, the content of the first driving signals SDR1 and the second driving signal SDR2 may depend on the types of the first pixels PA and the second pixels PB. For examples, if the first pixels PA and the second pixels PB are liquid crystal pixels, the first driving signals SDR1 and the second driving signal SDR2 may be a plurality of pixel voltages; if the first pixels PA and the second pixels PB are electrophoretic pixels, then the first driving signals SDR1 and the second driving signal SDR2 may be a plurality of driving waveforms.

Besides, the display reference data DRD received by the extending driving unit 140 may be the whole, part, or one of the display data DSD, namely the extending driving unit 140 generates the second driving signal SDR2 according to the whole, part, or one of the display data DSD. Meanwhile, since the display data DSD is generated according to the frame data FED of the display frame, the extending driving unit 140 is equivalent to generate the second driving signal SDR2 according to the display effect of the whole display frame, part display frame, or one of the pixels in the display frame.

Or, the display reference data DRD received by the extending driving unit 140 may be the whole, part, or one of the first driving signals SDR1, namely the extending driving unit 140 generates the second driving signal SDR2 according to the whole, part, or one of the first driving signals SDR1. Meanwhile, since the first driving signals SDR1 is generated according to the display data DSD (equivalent to correspond to the display frame), the extending driving unit 140 is equivalent to generate the second driving signal SDR2 according to the whole display frame, part display frame, or one of the pixels in the display frame. Moreover, since the content of the first driving signals SDR1 and the second driving signal SDR2 are corresponding to types of both the first pixels PA and the second pixels PB, the first driving signals SDR1 may be used to drive the second pixels PB. As the extending driving unit 140 generates the second driving signal SDR2 according to one of the first driving signals SDR1, the applied first driving signal SDR1 may be used as the second driving signal SDR2.

In the present embodiment, the first pixels PA are active pixels, while the second pixels are passive pixels, wherein each of the first pixels PA is coupled to a corresponding scan line 161 so as to receive a corresponding scan signal SC, is coupled to a corresponding data line 163 so as to receive the corresponding signal SDR1, and is coupled to a corresponding common voltage line 165 so as to receive the common voltage Vcom'. Each of the second pixels PB is coupled to a driving line 167 so as to receive the second driving signal SDR2, and is coupled to a common voltage line 169 so as to receive the common voltage Vcom'. In the present embodiment, the common voltage line 165 and 169 are coupled to each other, namely the common voltage Vcom' is transmitted to the first pixels PA and the second pixels PB simultaneously.

Figure 2:
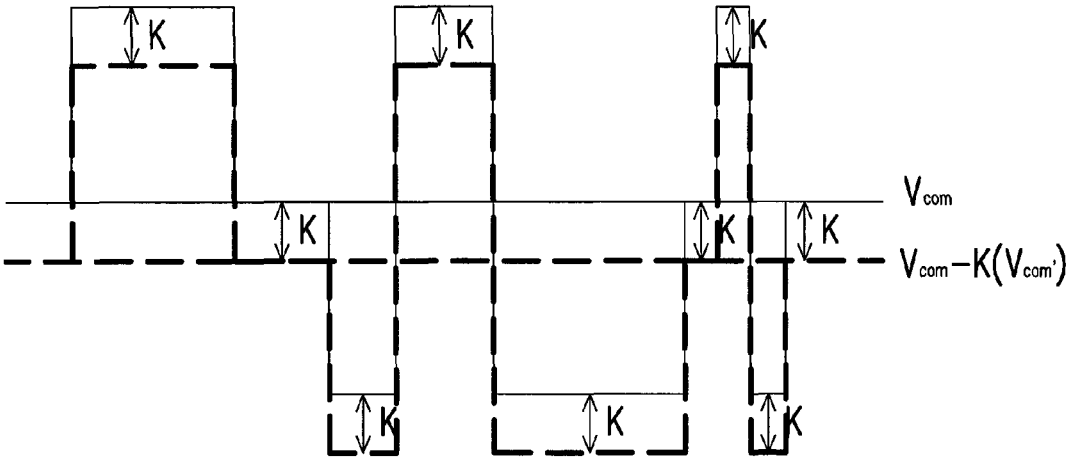
FIG. 2 is a schematic diagram of adjusting a common voltage corresponding to a feed-through voltage of first pixels.

FIG. 2 is a schematic diagram of adjusting a common voltage corresponding to a feed-through voltage of the first pixels. Referring to FIG. 1 and FIG. 2, in the present embodiment, since the first pixels PA are active pixels, the display effect of the first pixels PA may be affected by the feed-through voltage. In order to adjust the display effect of the first pixels PA, the common voltage Vcom' is usually adjusted correspondingly to the feed-through voltage of the first pixels PA.

Take the first driving signals SDR1 are a plurality of driving waveforms for example. Since the feed-through voltage K of the first pixels PA, every voltage level of the driving waveform are decreased by a feed-through voltage L (shown as the dotted line of the driving waveform), and thus the display effect of the first pixels is affected. In order to recover the display effect of the first pixels PA, the common voltage Vcom' may decrease correspondingly to the feed-through voltage K of the first pixels PA (shown as the dotted line of the common voltage), namely Vcom'=Vcom-K, wherein Vcom is the original common voltage.

However, since the second pixels PB are passive pixels and the common voltage Vcom' is transmitted to the first pixels PA and the second pixels PB simultaneously, the common voltage Vcom' adjusted according to the feed-through voltage K of the first pixels PA may affect the display effect of the second pixels PB. Meanwhile, the extending driving unit 140 may adjust the second driving signal SDR2 according to the feed-through voltage K of the first pixels PA so as to recover the original display effect of the second pixels PB.

In the present embodiment, the first pixels PA are active pixels, where the second pixels PB are passive pixels. But in the other embodiments, the first pixels PA and the second pixels PB may both be active pixels, depending on those skilled in the art. Moreover, the driving method of the first pixels PA and the second pixels PB may be adjusted correspondingly.

Figure 3:
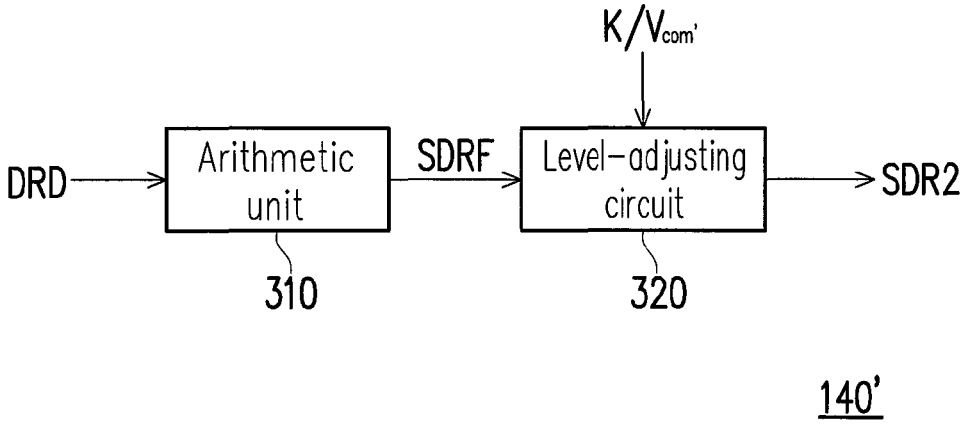
FIG. 3 is a system schematic diagram of an extending driving unit according to an embodiment of the invention.

FIG. 3 is a system schematic diagram of an extending driving unit according to an embodiment of the invention. Referring to FIG. 1, FIG. 2, and FIG. 3, in the present embodiment, the extending driving unit 140' includes an arithmetic unit 310 and a level-adjusting circuit 320. The arithmetic unit 310 is coupled to the level-adjusting circuit 320 and the data driving unit 130 so as to receive the display reference data DRD.

The arithmetic unit 310 determines the display effect of the second pixels PB according to the display reference data DRD, and thus provides the display reference signal SDRF. The level-adjusting circuit 320 is coupled to the arithmetic unit 310, receives the feed-through voltage K corresponding to the first pixels PA or the common voltage Vcom' provided by the power supply unit 150, and adjusts the voltage level of the display reference signal SDRF according to the feed-through voltage K of the first pixels PA or the common voltage Vcom' so as to produce the second driving signal SDR2. When the level-adjusting circuit 320 receives the feed-through voltage K, the voltage level of the display reference signal SDRF may be adjusted through the methods of clamping, level shifting, or arithmetic. When the level-adjusting circuit 320 receives the common voltage Vcom', the voltage level of the display reference signal SDRF may be adjusted through the method of arithmetic.

Since the level-adjusting circuit 320 adjusts the voltage level of the display reference signal SDRF, the display reference signal SDRF is substantially similar to the second driving signal SDR2, namely the content of the first driving signals SDR1, the second driving signal SDR2 and the display reference signal SDRF may depend on the types of the first pixels PA and the second pixels PB.

When the display reference data DRD is the whole, part, or one of the display data DSD, the arithmetic unit 310 determines the display effect of the second pixels PB according to the received display data DSD, namely the colors and/or grey scales represented by the display data DSD are calculated (e.g. averaged) to be the display effect of the second pixels PB. When the display reference data DRD is the whole, part, or one of the first driving signals SDR1, the arithmetic unit 310 determines the display effect of the second pixels PB according to the received first driving signals SDR1, namely the colors and/or grey scales represented by the first driving signals SDR1 are calculated (e.g. averaged) to be the display effect of the second pixels PB. When the display effect of the second pixels PB is determined, the arithmetic unit 310 generates the corresponding display reference signal SDRF according to the determined display effect of the second pixels PB so as to drive the second pixels PB to achieve the desired display effect.

When the display reference data DRD is one of the first driving signals SDR1, the first driving signals SDR1 may be used to drive the second pixels PB, and thus the arithmetic may be omitted as well as the arithmetic unit 310 thereof. Meanwhile, the chosen first driving signals SDR1 may be used as the display reference signal SDRF.

Figure 4:
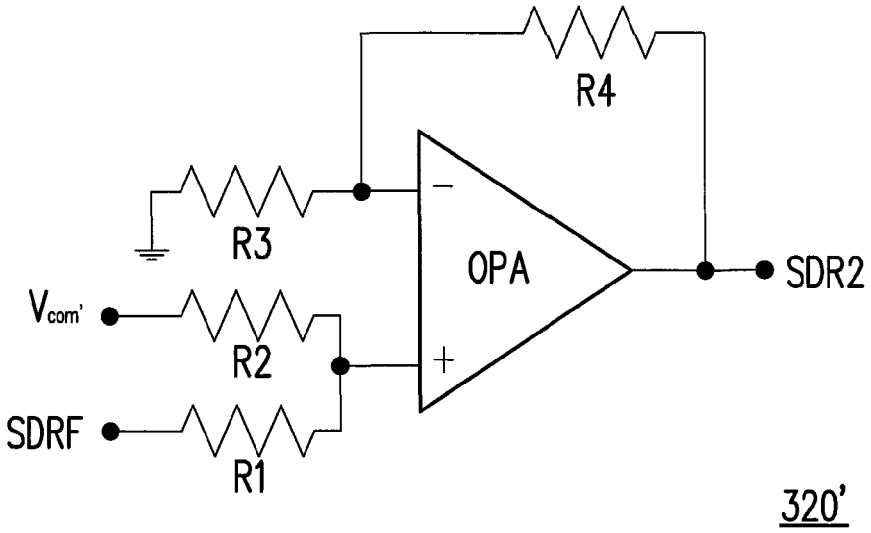
FIG. 4 is a circuit schematic diagram of a level-adjusting circuit according to an embodiment of the invention.

FIG. 4 is a circuit schematic diagram of a level-adjusting circuit according to an embodiment of the invention. Referring to FIG. 3 and FIG. 4, in the present embodiment, the level-adjusting circuit 320' includes a first operational amplifier OPA, a first resistor R1, a second resistor R2, a third resistor R3, and a fourth resistor R4, wherein the resistances of the first resistor R1, the second resistor R2, the third resistor R3, and the fourth resistor R4 are set to be the same. The first resistor R1 is coupled between the display reference signal SDRF and the positive input end (corresponding to the first input end) of the first operational amplifier OPA. The second resistor R2 is coupled between the common voltage Vcom' and the positive input end of the first operational amplifier OPA. The third resistor R3 is coupled between the ground voltage and the negative input end (corresponding to the second input end) of the first operational amplifier OPA. The fourth resistor R4 is coupled between the negative input end and the output end (corresponding to the first output end) of the first operational amplifier OPA. The output end of the first operational amplifier OPA outputs the second driving signal SDR2.

In accordance with the operation of circuit, SDR2=SDRF−Vcom'. Since Vcom'=Vcom−K, SDR2=SDRF−Vcom+K. According to the abovementioned, the level-adjusting circuit 320' shifting the voltage level of the display reference signal SDRF according to the common voltage Vcom' is equivalent to the voltage level of the display reference signal SDRF shifted according to the feed-through voltage K of the first pixels PA. Thus, the display effect of the second pixels may be recovered.

Figure 5:
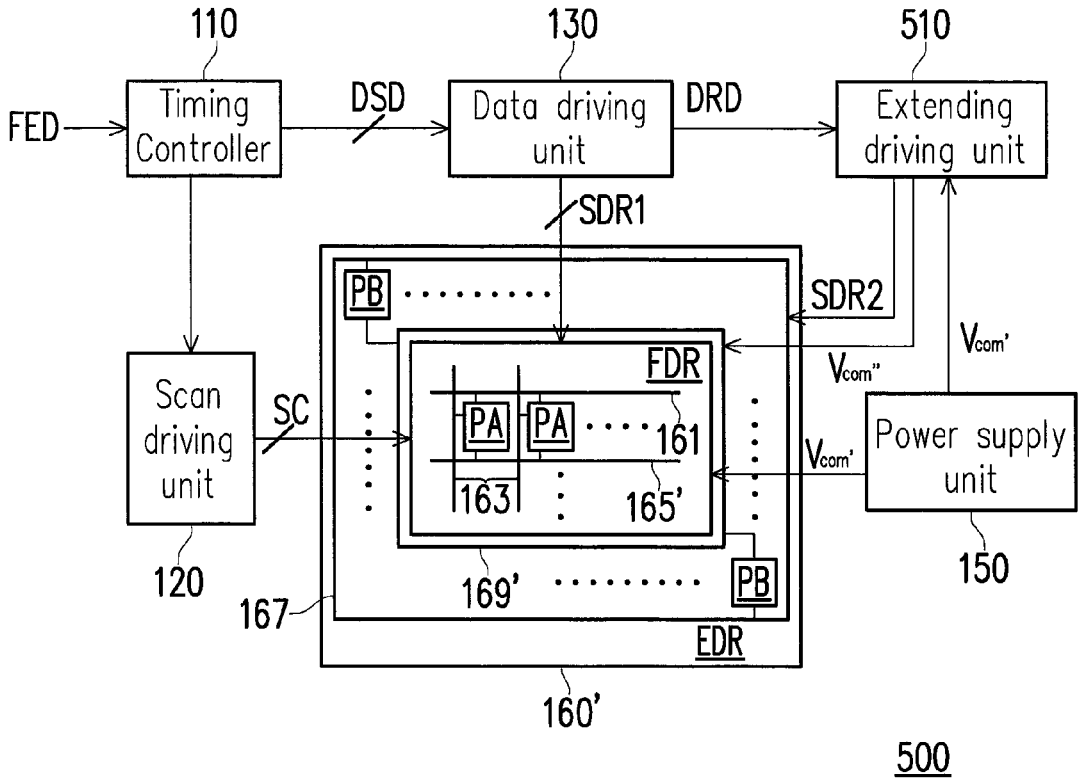
FIG. 5 is a system schematic diagram of a display apparatus according to another embodiment of the invention.

FIG. 5 is a system schematic diagram of a display apparatus according to another embodiment of the invention. Referring to FIG. 1 and FIG. 5, the differences mainly lie in the extending driving circuit 510 of the display apparatus 500. In the present embodiment, the common voltage line 165' and 169' of the display panel 160' are not coupled together. The common voltage Vcom' is transmitted directly to the first pixels PA, while the common voltage Vcom' of the power supply unit 150 is provided to the extending driving unit 510. The common voltage Vcom' is regulated by the extending driving unit 510 so as to provide the common voltage Vcom" to the second pixels PB.

If the second driving signal SDR2 is a driving waveform, the positive edge and the negative edge of the driving waveform vary dramatically (such as shown in FIG. 1). Since the second pixels PB may be regarded as a capacitor, the voltage change of the driving waveform may become a surge through the capacitive coupling effect of the second pixels PB such that the common voltage (e.g. Vcom') provided to the second pixels PB are affected, namely, the display effect of the second pixels PB are affected. Therefore, the extending driving unit 510 provides the common voltage Vcom" to the second pixels PB after regulating the common voltage Vcom' so as to reduce or eliminate the effect of the positive and negative edge of the driving waveform toward the common voltage Vcom" (equivalent to Vcom').

Figure 6:
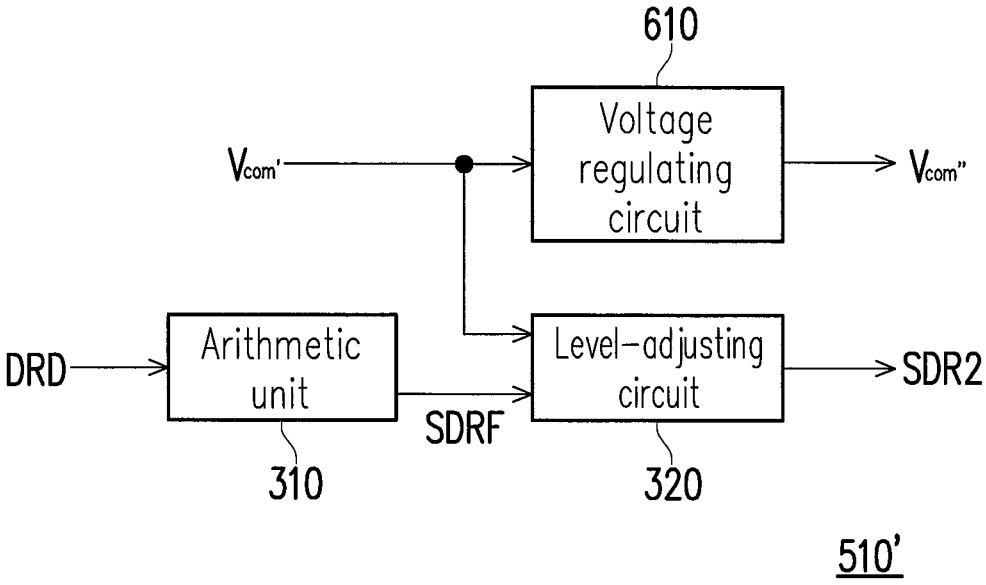
FIG. 6 is a system schematic diagram of the extending driving unit depicted in FIG. 5 according to an embodiment of the invention.

FIG. 6 is a system schematic diagram of the extending driving unit depicted in FIG. 5 according to an embodiment of the invention. Referring to FIG. 3, FIG. 5, and FIG. 6, in the present embodiment, the extending driving circuit 510' further includes a voltage regulating circuit 610, which receives the common voltage Vcom' and provides the regulated common voltage Vcom" to the second pixels PB, wherein the common voltage Vcom' and Vcom" are essentially identical.

Figure 7:
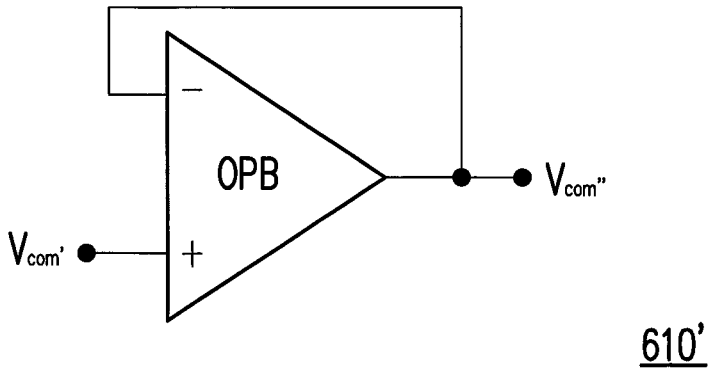
FIG. 7 is a circuit schematic diagram of the voltage regulating circuit depicted in FIG. 6 according to an embodiment of the invention.

FIG. 7 is a circuit schematic diagram of the voltage regulating circuit depicted in FIG. 6 according to an embodiment of the invention. Referring to FIG. 6 and FIG. 7, in the present embodiment, the voltage regulating circuit 610' includes a second operational amplifier OPB. The positive input end (corresponding to the third input end) of the second operational amplifier OPB receives the common voltage Vcom'. The negative input end (corresponding to the fourth input end) of the second operational amplifier OPB is coupled to the output end (corresponding to the second output end) of the second operational amplifier OPB, and the output end of the second operational amplifier OPB is coupled to the second pixels PB to output the common voltage Vcom".

Figure 8:
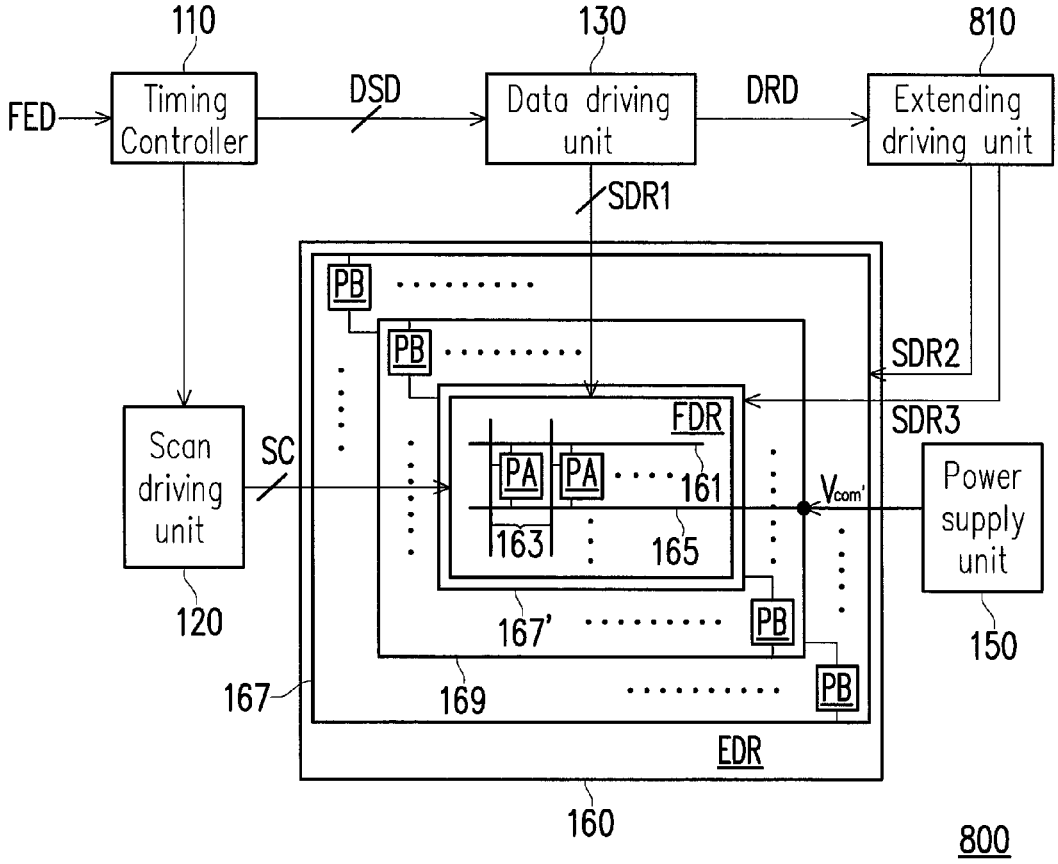
FIG. 8 is a system schematic diagram of a display apparatus according to a further embodiment of the invention.

FIG. 8 is a system schematic diagram of a display apparatus according to a further embodiment of the invention. Referring to FIG. 1 and FIG. 8, the differences mainly lie in the extending driving circuit 810 of the display apparatus 800. In the present embodiment, the extending driving circuit 810 generates the second driving signal SDR2 and the third driving signal SDR3 according to the display reference data DRD, wherein the second driving signal SDR2 is different from the third driving signal SDR3.

Besides, part of the second pixels PB disposed in the extending display region EDR is coupled between the driving line 167 and the common voltage line 169 so as to receive the second driving signal SDR2 and common voltage Vcom'. Part of the second pixels PB disposed in the extending display region EDR is coupled to the driving line 167' and the common voltage line 169 so as to receive the third driving signal SDR3 and common voltage Vcom'. Since the second driving signal SDR2 is different with the third driving signal SDR3, the second pixels PB may show different color effects (e.g. gradient, or contrast) according to the received second driving signal SDR2 or the third driving signal SDR3 respectively.

Figure 9:
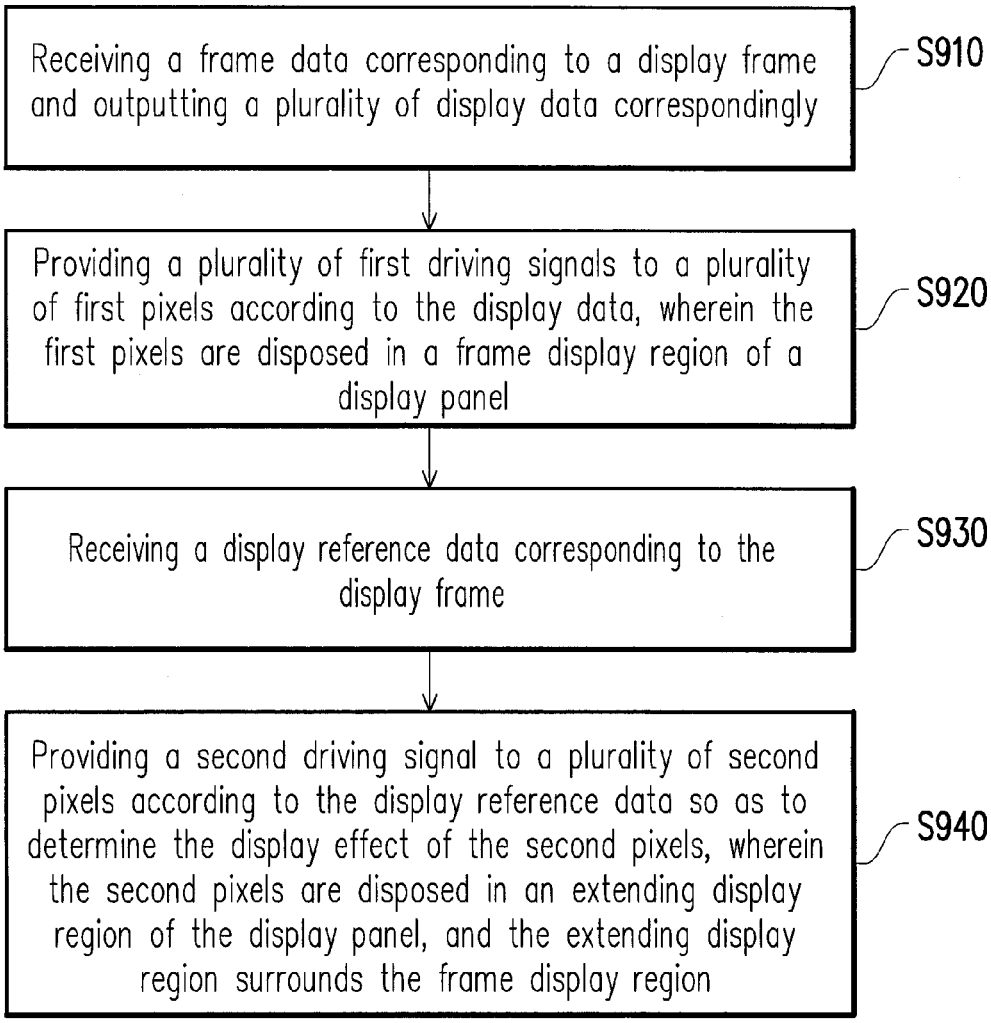
FIG. 9 is a flow diagram of a display method of a display apparatus according to an embodiment of the invention.

FIG. 9 is a flow diagram of a display method of a display apparatus according to an embodiment of the invention. Referring to FIG. 9, in the present embodiment, the display method of the display apparatus includes the following steps. Receiving a frame data corresponding to a display frame and outputting correspondingly a plurality of display data (step S910), and providing a plurality of first driving signals to a plurality of first pixels according to the display data, wherein the first pixels are disposed in a frame display region of a display panel (step 920). Then, receiving a display reference data corresponding to the display frame (step S930), and the second driving signal is provided to a plurality of second pixels according to the display reference data such that the display effect of the second pixels may be determined (step S940). Wherein, the second pixels are disposed in an extending display region of the display panel, and the extending display region surrounds the frame display region.

Figure 10:
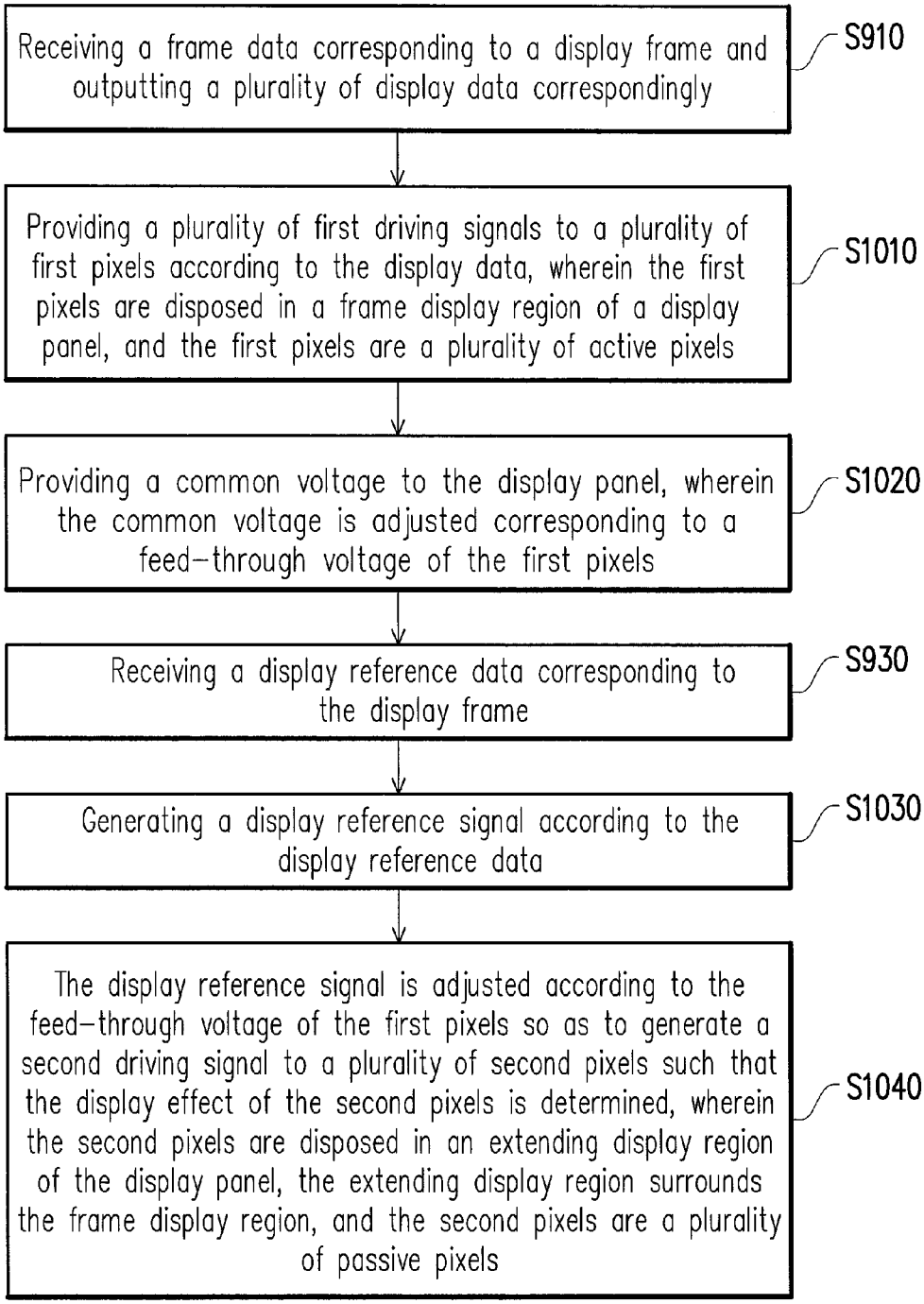
FIG. 10 is a flow diagram of a display method of a display apparatus according to another embodiment of the invention.

FIG. 10 is a flow diagram of a display method of a display apparatus according to another embodiment of the invention. Referring to FIG. 9 and FIG. 10, in the present embodiment, the different processes lie in step S1010, S1020, S1030, and S1040. In the step S1010, a plurality of first driving signals are provided to a plurality of first pixels according to the display data, wherein the first pixels are disposed in a frame display region of a display panel and the first pixels are a plurality of active pixels. In step S1020, a common voltage is provided to the display panel, wherein the common voltage is adjusted corresponding to a feed-through voltage of the first pixels. In step S1030, a display reference signal is generated according to the display reference data. In step S1040, the display reference signal is adjusted according to the feed-through voltage of the first pixels so as to generate a second driving signal to a plurality of second pixels such that the display effect of the second pixels is determined. Wherein the second pixels are disposed in an extending display region of the display panel, the extending display region surrounds the frame display region, and the second pixels are a plurality of passive pixels.

Figure 11:
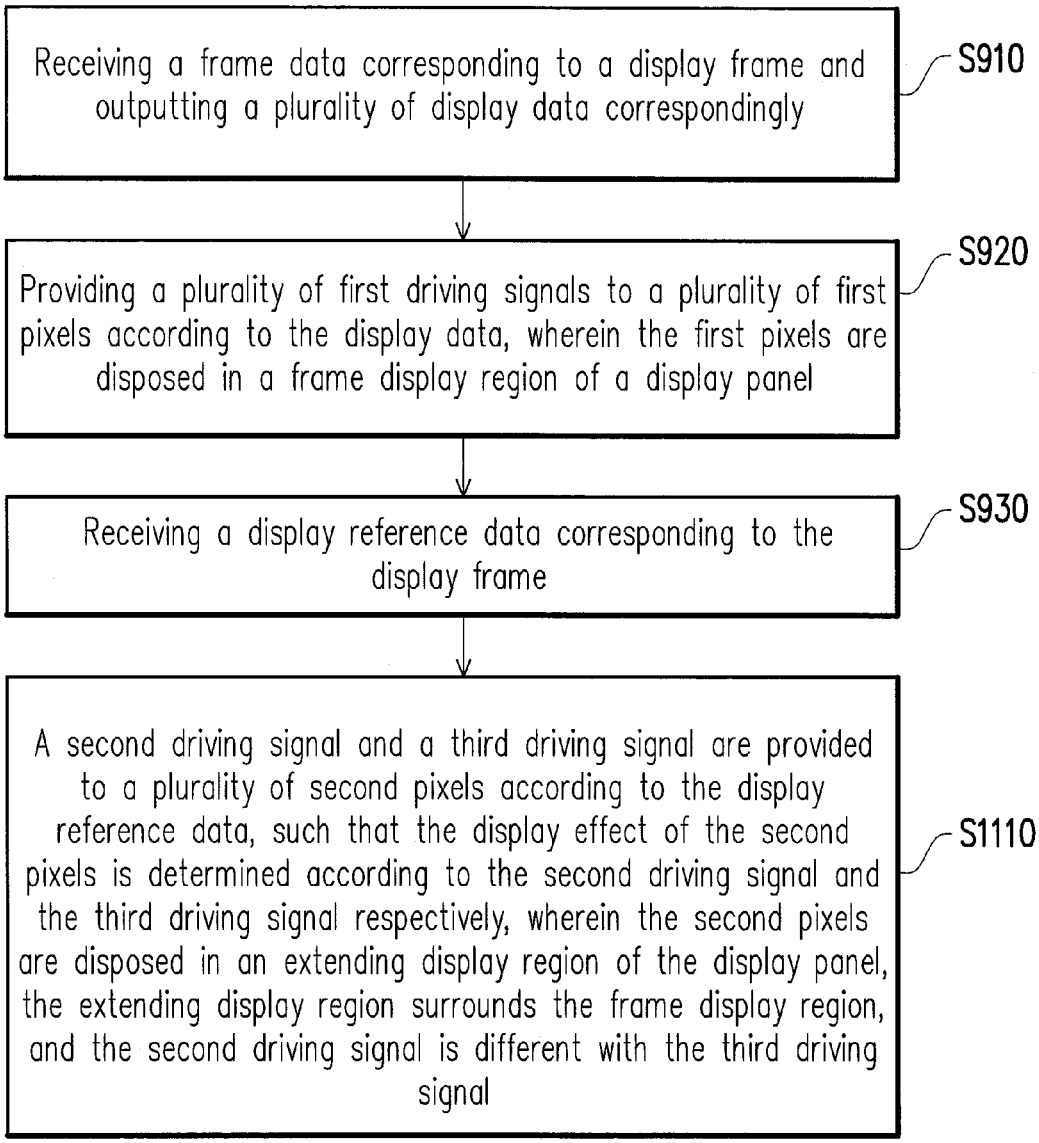
FIG. 11 is a flow diagram of a display method of a display apparatus according to a further embodiment of the invention.

FIG. 11 is a flow diagram of a display method of a display apparatus according to a further embodiment of the invention. Referring to FIG. 9 and FIG. 11, in the present embodiment, the different processes lie in step S1110. In step S1110, a second driving signal and a third driving signal are provided to a plurality of second pixels according to the display reference data, such that the display effect of the second pixels is determined according to the second driving signal and the third driving signal respectively. Wherein the second pixels are disposed in an extending display region of the display panel, the extending display region surrounds the frame display region, and the second driving signal is different with the third driving signal.

Besides, the order of the abovementioned steps in FIG. 9 to FIG. 11 are used to illustrate, the embodiments of the invention are not limited thereto. The details in each step may refer to the directions in FIG. 1 to FIG. 8, and are not addressed herein.

In summary, the display apparatus and the display method thereof of the embodiments of the invention generate the second driving signal according to the display reference data corresponding to the display frame, such that the display effect of the extending display region may change correspondingly to the display frame shown in frame display region so as to improve the display effect of the display frame. Besides, when the first pixels are active pixels, the common voltage and the display reference signal corresponding to the display reference data may adjust according to the feed-through voltage of the first pixels, such that the display effect of the second pixels are not affected by the common voltage adjustment according to the feed-through voltage of the first pixels. Moreover, the third driving signal different from the second driving signal may then be generated according to the display reference data, such that the second pixels show different color effects according to the second driving signal or the third driving signal respectively.

It will be apparent to the skilled in the art that various modifications and variations can be made to the structure of the disclosed embodiments without departing from the scope or spirit of the invention. In view of the foregoing, it is intended that the invention cover modifications and variations of this invention provided they fall within the scope of the following claims and their equivalents.

What is claimed is:

1. A display apparatus comprising:

a display panel having a plurality of first pixels and a plurality of second pixels, wherein the first pixels are disposed in a frame display region of the display panel, the second pixels are disposed in an extending display region of the display panel, and the extending display region surrounds the frame display region;

a timing controller receiving a frame data corresponding to a display frame and outputting a plurality of display data correspondingly;

a data driving unit coupled to the first pixels and the timing controller so as to receive the display data, and providing a plurality of first driving signals to the first pixels according to the display data;

an extending driving unit coupled to the second pixels and the data driving unit and receiving a display reference data corresponding to the display frame through the data driving unit, and the extending driving unit provides a second driving signal to the second pixels according to the display reference data so as to determine a display effect of the second pixels; and a power supply unit coupled to the display panel for providing a common voltage to the display panel, wherein the common voltage is adjusted corresponding to a feed-through voltage of the first pixels, wherein the extending driving unit comprises:

a level-adjusting circuit for receiving a display reference signal corresponding to the display reference data and adjusting the display reference signal so as to generate the second driving signal according to the feed-through voltage, wherein the level-adjusting circuit comprises:

a first operational amplifier having a first input end, a second input end and a first output end, wherein the first output end outputs the second driving signal;

a first resistor coupled between the display reference signal and the first input end;

a second resistor coupled between the common voltage and the first input end;

a third resistor coupled between a ground voltage and the second input end; and a fourth resistor, coupled between the second input end and the first output end.

2. The display apparatus as recited in claim 1, wherein the first pixels are a plurality of active pixels, and the second pixels are a plurality of passive pixels.

3. The display apparatus as recited in claim 1, wherein the extending driving unit further comprises a voltage regulating circuit, and the common voltage is provided to the second pixels through the voltage regulating circuit, and the common voltage is provided directly to the first pixels.

4. The display apparatus as recited in claim 3, wherein the voltage regulating circuit comprises:

a second operational amplifier having a third input end, a fourth input end, and a second output end, wherein the third input end receives the common voltage, the fourth input end is coupled to the second output end, and the second output end is coupled to the second pixels.

5. The display apparatus as recited in claim 1, wherein the display reference data is the whole, part, or one of the display data, and the extending driving unit further comprises:

an arithmetic unit coupled to the level-adjusting circuit and the data driving unit so as to provide the display reference signal to the level-adjusting circuit according to the display reference data.

6. The display apparatus as recited in claim 1, wherein the display reference data is the whole or part of the first driving signals, and the extending driving unit further comprises:

a arithmetic unit coupled to the level-adjusting circuit and the data driving unit so as to provide the display reference signal to the level-adjusting circuit according to the display reference data.

7. The display apparatus as recited in claim 1, wherein when the display reference data is one of the first driving signals, the display reference signal is the same with the display reference data.

8. The display apparatus as recited in claim 1, wherein the extending driving unit further determines a third driving signal according to the display reference data, wherein the display effect of the second pixels is determined according to the second driving signal and the third driving signal respectively, wherein the second driving signal is different from the third driving signal.

* * * * *